US005475796A

United States Patent [19]

Iwata

[11] Patent Number: 5,475,796

[45] Date of Patent: Dec. 12, 1995

[54] PITCH PATTERN GENERATION APPARATUS

[75] Inventor: Kazuhiko Iwata, Tokyo, Japan

[73] Assignee: NEC Corporation, Tokyo, Japan

[21] Appl. No.: 993,858

[22] Filed: Dec. 21, 1992

[30] Foreign Application Priority Data

Dec. 20, 1991 [JP] Japan ..... 3-338654

[51] Int. Cl.[6] ..... G10L 5/02; G10L 9/00

[52] U.S. Cl. ..... 395/2.69; 395/2.63; 395/2.77

[58] Field of Search ..... 395/2.69, 2.16, 395/2, 2.77; 381/52

[56] References Cited

U.S. PATENT DOCUMENTS

| | | | |
|---|---|---|---|
| 3,704,345 | 11/1972 | Coker | 395/2.69 |
| 4,278,838 | 7/1981 | Antonov | 395/2.69 |
| 4,783,811 | 11/1988 | Fisher et al. | 395/2.69 |
| 4,802,223 | 1/1989 | Lin et al. | 395/2.16 |
| 4,907,279 | 3/1990 | Higuchi et al. | 381/52 |
| 5,146,405 | 9/1992 | Church | 364/419 |
| 5,157,759 | 10/1992 | Bachenko | 395/2 |
| 5,220,629 | 6/1993 | Kosaka et al. | 381/52 |

OTHER PUBLICATIONS

Learning of Word Stress in a Sub–Optimal Second Order Back–Propagation NN Ricotti et al IEEE/Jul. 1988.

Realization of Linguistic Information in the voice Fundamental frequency contour, Fujisaki et al IEEE/Apr. 1988.

*Primary Examiner*—David D. Knepper

*Assistant Examiner*—Richemond Dorvil

*Attorney, Agent, or Firm*—Sughrue, Mion, Zinn, Macpeak & Seas

[57] ABSTRACT

A pitch pattern defining intonation for a text-to-speech system is generated in accordance with a part of speech (e.g., noun, verb, adjective, adverb, etc.) of each word which can be determined more accurately than the syntactic structure of a sentence. The pitch pattern is generated in response to the combinations of parts of speech of adjacent words in a sentence based on the fact that any combination in parts of speech of two words at both sides of each word boundary reflects the strength of connection in meaning of the adjacent words.

4 Claims, 5 Drawing Sheets

| WORD | He | bought | a | white | flower. |
|---|---|---|---|---|---|
| A PART OF SPEECH | PRONOUN | VERB | INDEFINITE ARTICLE | ADJECTIVE | NOUN |
| A PART OF SPEECH COMBINATION AT THE WORD BOUNDARY | PRONOUN +VERB | VERB + INDEFINITE ARTICLE | INDEFINITE ARTICLE + ADJECTIVE | ADJECTIVE + NOUN | |
| STRESS LEVEL RATIOS | 0.7 | 0.8 | 1.5 | 0.9 | |
| RELATIVE STRESS LEVEL OF THE FIRST WORD | 1.0 | 0.7 | 0.56 | 0.84 | 0.76 |
| STRESS LEVEL VALUE [Hz] | 80.0 | 56.0 | 44.8 | 67.2 | 60.8 |
| ACCENT COMPONENT |  | | | | |

FIG.5

| COMBINATION OF PARTS OF SPEECH | STRESS LEVEL RATIO |
|---|---|
| PRONOUN + VERB | 0.7 |
| VERB + INDEFINITE ARTICLE | 0.8 |
| ADJECTIVE + NOUN | 0.9 |
| ⋮ | ⋮ |
| INDEFINITE ARTICLE + ADJECTIVE | 1.5 |
| ⋮ | ⋮ |

PITCH PATTERN GENERATION APPARATUS

BACKGROUND OF THE INVENTION

The present invention relates to a pitch pattern generation apparatus to define the intonation in a speech synthesizer and the like for converting an input sentence consisting of a character string into synthetic speech.

It is very important in improving quality of speech synthesis to generate natural pitch pattern in a speech synthesizer and the like to convert an input sentence into speech. A conventional manner of pitch pattern generation is to use phrase components gradually descending over the entire speech superimposed with accent components depending on each word. For example, the phrase components are simulated by either a monotonously descending linear pattern or a hill type pattern ascending first and then descending linearly. That is, the accent components are simulated by a broken line. Such prior art is disclosed, for example, in "The Investigation of Prosodic Rules in Connected Speech", The Acoustical Society of Japan; Transactions of the Committee on Speech Research S78-07 (April 1978) (Reference 1).

Such conventional pitch pattern generation technique will be described hereunder by reference to FIG. 3. This is an example of generating a pitch pattern for "He bought a white flower" consisting of 5 words. Represented in FIG. 3(A) are accent components simulated by a broken line having 5 hills. The shape of each hill is determined by the accent type, number of morae, etc. of each word. This accent component (A) is superimposed with the phrase component or the descending linear line as shown in (B) to generate the overall text pitch pattern as shown in (C). L1 through L5 in FIG. 3 are known as stress levels. The relative strength of the stress levels for adjacent words represents the sentence structure and is important to naturalness in the pitch. That is, if connection between two adjacent words is weak, the subsequent word will have a larger stress level than the preceding word. On the contrary, if adjacent two words have stronger connection in meaning, the subsequent word will have a small stress level.

In the conventional pitch pattern generation technique as described in Reference 1 and the like, a number of words between the preceding word and the connection word, which is known as a separation degree, is used as a measure to determine the connection strength of adjacent words. The separation degree is determined by the syntactic structure of a particular sentence. If the separation degree is large at a certain word boundary, the preceding word over the boundary is connected in meaning to a word at more remote location, thereby making the connection with the next subsequent word very weak. On the other hand, if a preceding word is directly connected to the next subsequent word, the separation degree will be the minimum or 1. At a word boundary having a larger separation degree, the stress level for the subsequent word is made larger than that for the preceding word. On the contrary, at word boundary having a smaller separation degree, the subsequent word will have a lower stress level than that of the preceding word.

As described above, the conventional pitch pattern generation technique determines the stress level of each word depending on the strength of connection between adjacent words in the particular structure of the sentence. The accent components determined by the above manner are superimposed with the phrase components, thereby generating the pitch pattern for the entire sentence.

Although the conventional pitch pattern generation technique is based on the premise that the syntactic structure of a sentence can be obtained correctly, it is not always easy to accurately analyze the syntactic structure of a sentence. As a result, the generated pitch pattern is not natural due to errors in the syntactic analysis of a sentence.

SUMMARY OF THE INVENTION

It is therefore an object of the present invention to provide a pitch pattern generation apparatus capable of generating a natural pitch pattern without using the connection structure of a sentence.

The pitch pattern generation apparatus according to the present invention is to generate a pitch pattern defining intonation for a text-to-speech system in accordance with a part of speech (e.g., noun, verb, adjective, adverb, etc.) of each word which can be determined more accurately than the syntactic structure of a sentence. It is believed that any combination in parts of speech of two words at both sides of each word boundary reflects the strength of connection in meaning of the adjacent words. Consequently, the pitch pattern generator according to the present invention generate the pitch pattern in response to the combinations of parts of speech of adjacent words in a sentence.

BRIEF DESCRIPTION OF THE DRAWINGS

FIG. 5 is an example of stress level ratios for different combinations of parts of speech.

PREFERRED EMBODIMENTS

The pitch pattern generation apparatus according to the present invention will be described on preferred embodiments by reference to the accompanying drawings. The above mentioned and other objects of the present invention will be apparent from the following description by reference to the drawings.

Figure 4:
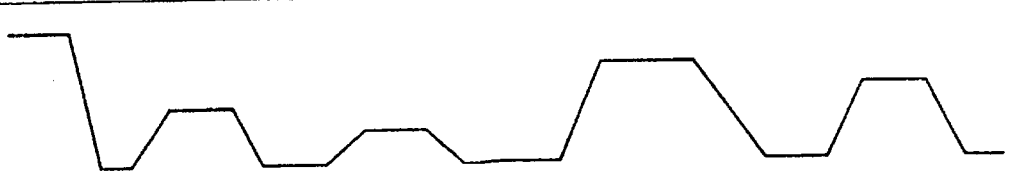
FIG. 4 is an explanatory drawing to show the way of generating the pitch pattern according to the present invention.

Firstly, a reference is made to FIG. 4 illustrating the way of generating the pitch pattern according to the present invention. The particular example of a sentence consists of five words "He", "bought", "a", "white" and "flower". A part of speech combination at the boundary of "white" and "flower" is "adjective+noun". This combination suggests that the preceding adjective modifies directly the subsequent noun.

Accordingly, the stress level ratios for all words at both sides of word boundaries are determined in advance based on the combinations of two parts of speech. The stress level ratio means the relative stress level of the preceding word with respect to the subsequent word or the reciprocal thereof. FIG. 5 shows examples of stress level ratios for combinations of various parts of speech. These ratios can be determined by normal human speeches.

In generating the pitch pattern, a first thing is to carry out morpheme analysis of the sentence to be converted for dividing into words and determining their parts of speech. Then, the stress level ratio of the words at both sides of each word boundary is determined by their parts of speech. In FIG. 4, the stress level for "flower" is, for example, 0.9 time of the preceding word "white". Such value is determined by the fact that the two words are a combination of "adjective+noun". The stress level ratio at each word boundary is determined in the above manner, thereby obtaining the stress level ratios for all words with respect to the word at the head of the sentence. For example, the stress level ratio for "a" with respect to "He" can be determined, by 1.0×0.7×0.8=0.56. As a result, the stress levels for all words in the sentence can be calculated if the stress level for the head word is given (e.g., 80 Hz). The accent component obtained or calculated in the above manner is superimposed with the phrase component to generate the pitch pattern for the sentence.

Now, one embodiment of the construction of the pitch pattern generation apparatus will be described by reference to FIG. 1. A character string of a sentence or text to be converted is received at a character string input terminal 11. The received character string is, then, sent to a morpheme analyzer section 12 where the sentence expressed by the character string is decomposed into words to determine a part of speech of each word of each word boundary. The result of the analysis is sent to an accent component generation section 13 and a phrase component generation section 15. Stored in a stress level ratio memory section 14 are stress level ratios for words at both sides of word boundaries depending on the parts of speech combinations for such words.

The accent component generation section 13 reads out the stress level ratios from the stress level ratio memory section 14 in response to the particular parts of speech combination of the words at both sides of each word boundary and generates the accent component by determining the stress levels for all words in the sentence in the manner described hereinbefore.

The phrase component-generation section 15 decomposes the input sentence into a plurality of phrase components, if necessary, based on the result of analysis in the morpheme analyzer section 12, thereby generating a phrase component simulated by a linear line of gradually decreasing pitch frequency with respect to time.

A pitch pattern generation section 16 is to generate a pitch pattern of the entire sentence by combining the accent components and the phrase components generated by the accent component generation section 13 and the phrase component generation section 15, respectively. The pitch pattern output is available from an output terminal 17.

Figure 1:
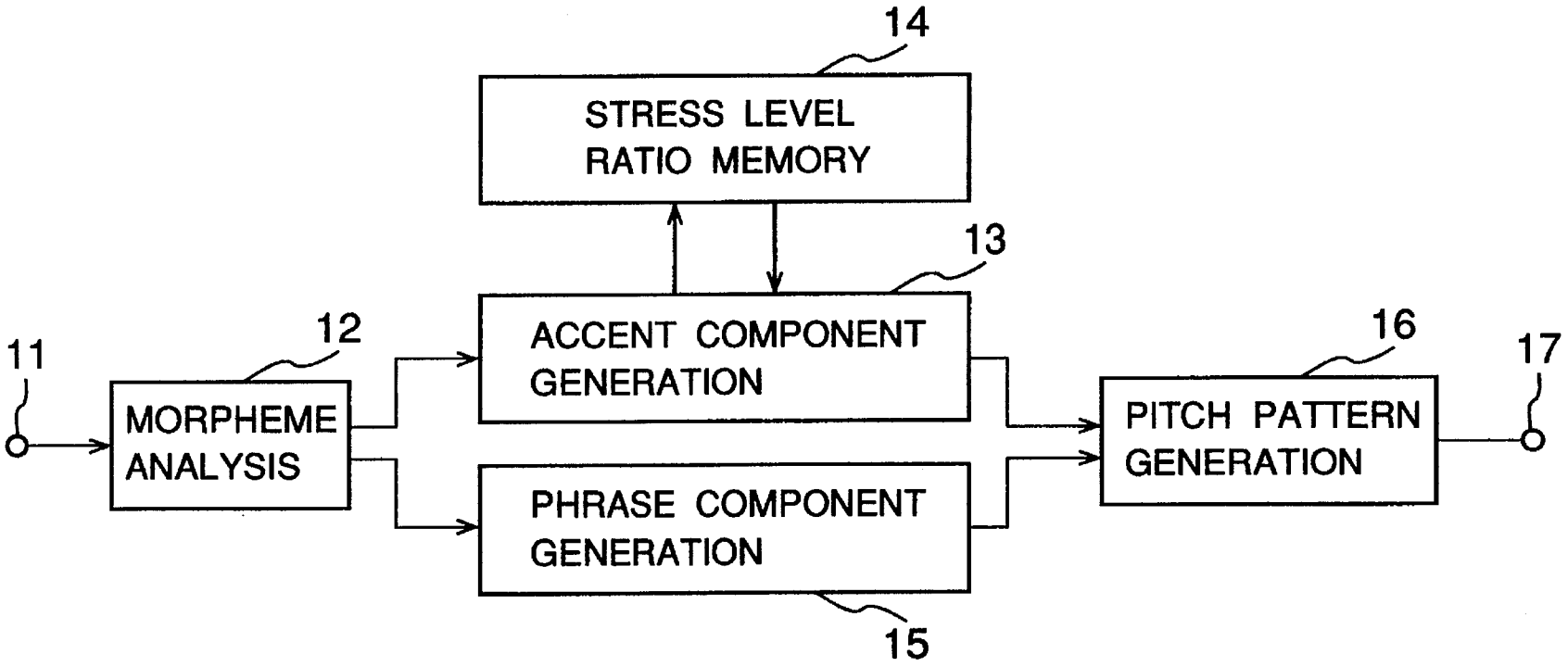
FIG. 1 is a block diagram of one embodiment to achieve the pitch pattern generation apparatus according to the present invention.
Figure 2:
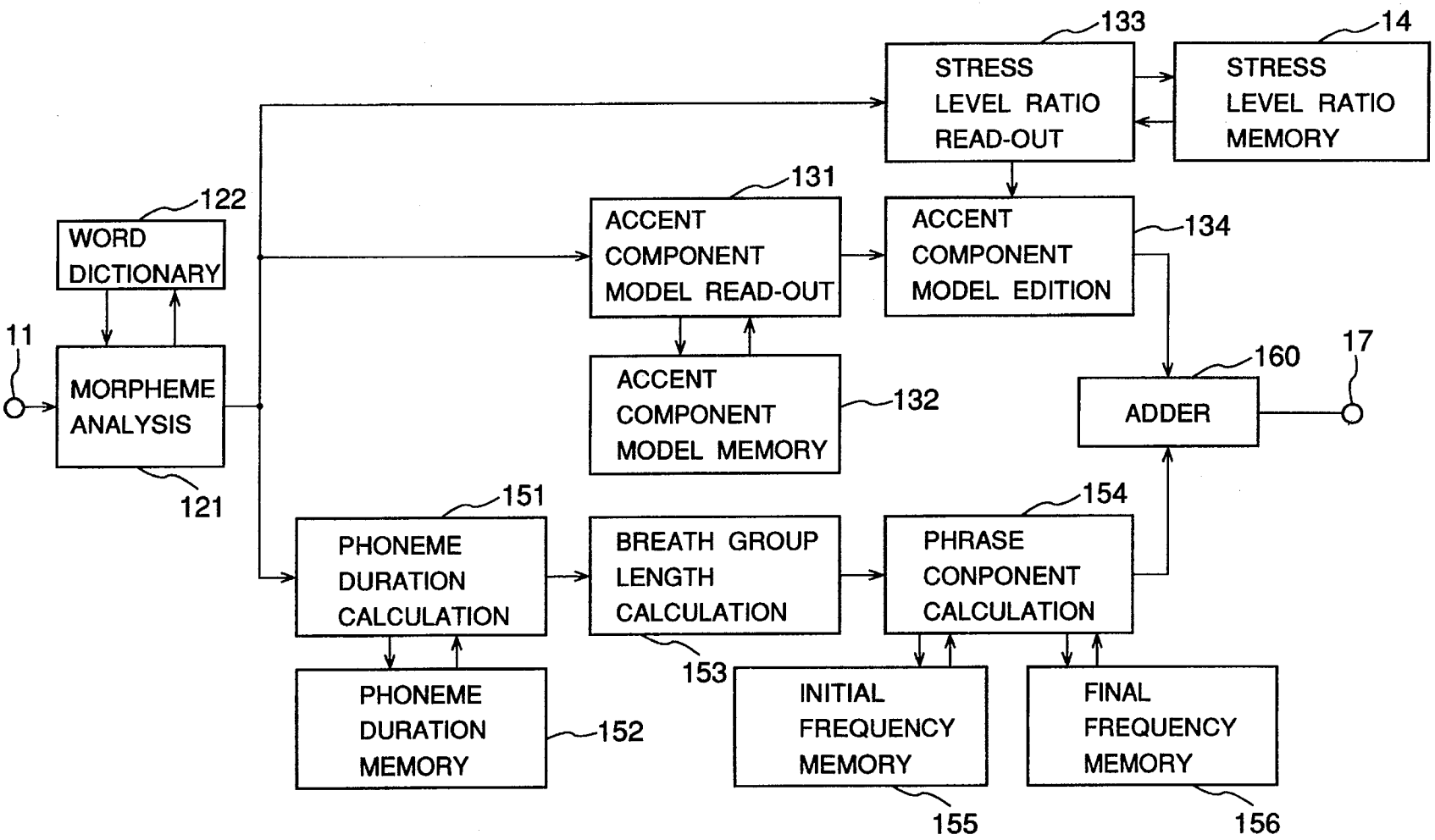
FIG. 2 is a detailed block diagram of the apparatus in FIG. 1.
Figure 3:
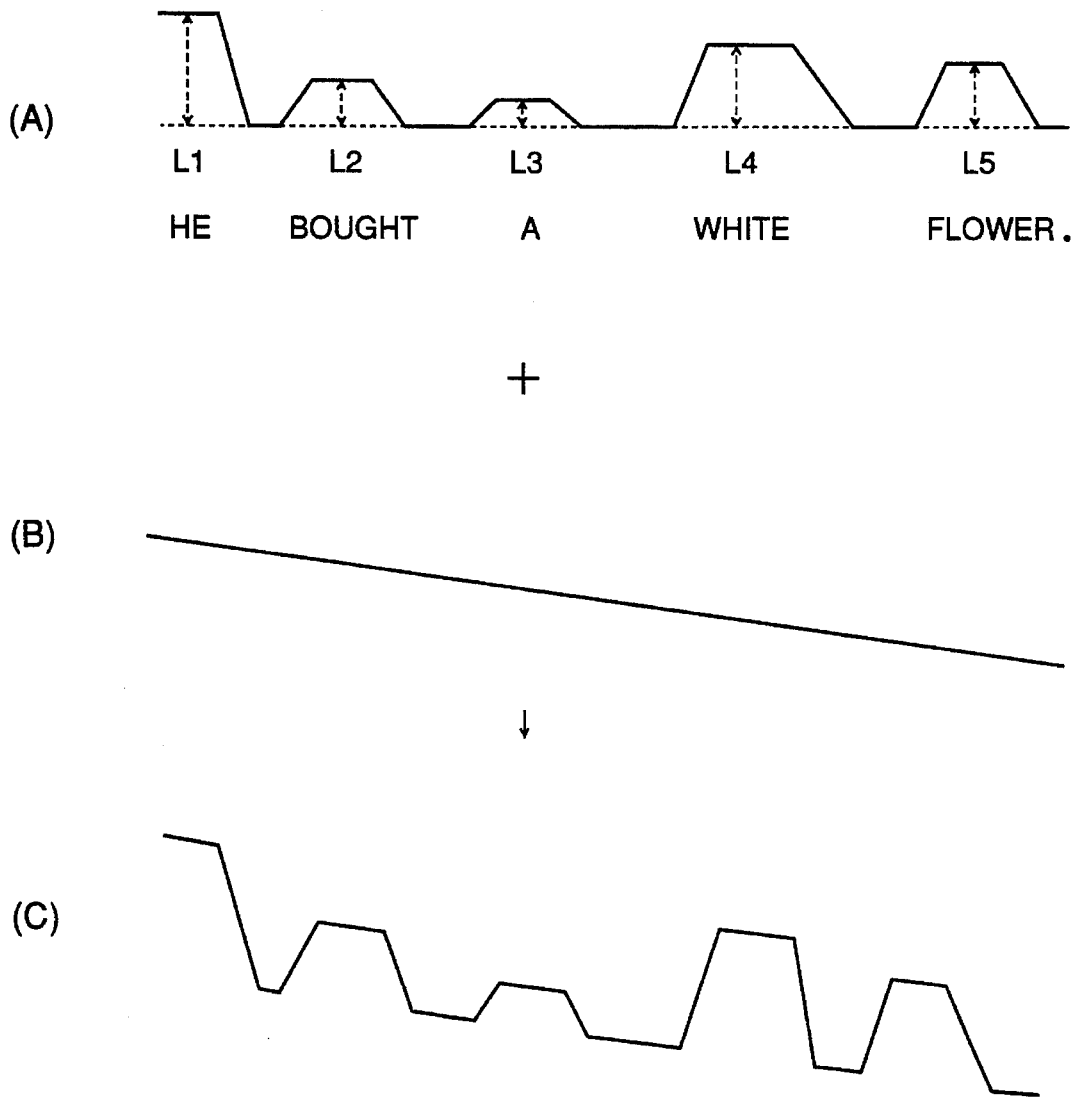
FIG. 3(A)–(C) is an explanatory drawing to show the conventional way of generating the pitch pattern.

FIG. 2 shows a more detailed block diagram than FIG. 1, wherein the same reference numerals are used to refer to elements having like or corresponding functions.

Firstly, a character string to be converted into speech is received at a character string input terminal 11. The input character string is sent to a morpheme analysis section 121. The morpheme analysis section 121 consults a word dictionary 122 to distinguish words from the input character string and to determine pronunciation, part of speech, accent type, and word boundary location. In English language, morphemes are easily detected, since morphemes correspond to words, and spaces are placed around words. This is not true, in contrast, for a language such as Japanese, in which sentences are written without spacing, and thus, there is no pause between successive morphemes.

The morpheme analysis unit 121 separates a given sentence into morphemes with reference to the word dictionary 122 and by using a known algorithm. Examples of known algorithms are used in U.S. Pat. Nos. 4,931,936, issued to Shuzo Kugimiya, et al., and 4,771,385, issued to Kazunari Egami, et al.

Pronunciation, part of speech, accent type and word boundary location of each word generated from the morpheme analysis section 121 are sent to an accent component model read-out section 131, a stress level ratio read-out section 133 and a phoneme duration calculation section 151.

Stored in the accent component model memory section 132 is an outline of pitch pattern for each accent type of word. The accent component model read-out section 131 reads the outline of pitch pattern of the word stored in the accent component model memory section 132 in accordance with the accent type for each word being sent from the morpheme analysis section 121. The read-out outline of pitch pattern for each word is sent to an accent component model editing section 134.

A stress level ratio memory section 14 has stored stress level ratios for all combinations of parts of speech of two words at both sides of the word boundaries as illustrated in the example in FIG. 5. The stress level ratio read-out section 133 reads the stress level ratios out of the stress level ratio memory section 14 for the particular combination of parts of speech of two words at both sides of the word boundary.

The accent component model editing section 134 utilizes the stress level ratio read out of the stress level ratio read-out section 133 to determine the stress levels for all words in the input character string in such a manner as described in the above operation. Also generated is the accent components for the entire sentence by modifying the stress level of pitch pattern for the words read out of the accent component model read-out section 131.

Referring now to the phoneme duration calculation section 151 which calculates the duration for each phoneme to be converted by using the reading or a series of phonemes of each word detected from the morpheme analysis section 121. This can be done by, for example, reading the average duration for each phoneme previously stored in a phoneme duration memory section 152.

A breath group length calculation section 153 calculates the duration of each breath group in a sentence. In this specification, the breath group means a unit of speech separated by a pause. A phrase component is generated for each breath group. If no pause does exist in a sentence, the sentence has only one breath group. If there is one pause In a sentence, the sentence consists of two breath groups. A judgement where to insert a pause in a sentence is not directly related to the subject matter of the present invention, and is omitted in the specification. The breath group length calculation section 153 calculates the duration for each breath group in a sentence by adding the durations of all phonemes included in the breath group.

A phrase component calculation section 154 reads the initial and final pitch frequencies respectively from an initial frequency memory section 155 and a final frequency memory section 156 in order to determine the outline of the phrase component. Additionally, the duration for each breath group calculated by the breath group length calculation section 153 is used to calculate the slope of the phrase component by the following expression:

slope of phrase component [Hz/sec]=(final phrase component frequency [Hz]–initial phrase component frequency [Hz])/breath group duration [sec]

Finally, an adder 160 adds the accent component calculated by the accent component model editing section 134 and the phrase component calculated by the phrase component calculation section 154, thereby calculating the pitch pattern of the input sentence to output from the pitch pattern output terminal 17.

As described hereinbefore, the present invention can generate more natural pitch pattern than the conventional technique because the pitch pattern can be determined without using the analysis of syntactic structure of a sentence which is difficult to analyze accurately. As a result, the pitch pattern generation apparatus according to the present invention is particularly useful for a text-to-speech synthesizer to convert a character string into speech.

Although the construction and operation of the pitch pattern generation apparatus is described hereinbefore by reference to accompanying drawings illustrating one preferred embodiment, it is to be appreciated that various modifications can be made for a person having an ordinary skill in the art without departing from the scope and spirit of the present invention.

What is claimed is:

1. A pitch pattern generation apparatus for generating a pitch pattern to define information for a speech synthesizer apparatus to convert an input sentence into synthetic speech comprising:

a stress level ratio memory section to store stress level ratios for combinations of adjacent parts of speech;

a morpheme analysis section to separate the input sentence into discrete words and to determine the part of speech of each word;

an accent component generation section to read out the stress strength as accent components from said stress level ratio memory section in response to parts of speech combinations of adjacent words in said input sentence; and a pitch pattern generation section to generate the pitch pattern based on the read out accent components.

2. A pitch pattern generation apparatus in accordance with claim 1, wherein said pitch pattern generation section generates the pitch pattern by superimposing the accent components read out of said accent component generation section and a phrase component of the sentence.

3. A pitch pattern generation apparatus in accordance with claim 1, wherein said pitch pattern generation section gives a pitch frequency for at least one point per word to determine a shape of each word, thereby generating the pitch pattern for the entire sentence.

4. The pitch pattern generation apparatus of claim 1 wherein said accent component generation section reads out the stress strength from said stress level ratio memory section in response to said parts of speech combinations at both sides of said discrete words of said input sentence.

* * * * *